United States Patent [19]

Westmoreland

[11] 4,238,983

[45] Dec. 16, 1980

[54] MACHINE FOR MAKING WOOD STAKES

[76] Inventor: Mark Westmoreland, 1500 Alexander Dr., Baytown, Tex. 77520

[21] Appl. No.: 47,368

[22] Filed: Jun. 11, 1979

[51] Int. Cl.[3] ..... B27B 27/08; B27B 5/16

[52] U.S. Cl. ..... 83/408; 83/719; 83/730; 83/435.1; 83/255; 144/3 R; 144/30; 83/491; 83/718; 83/404; 83/597

[58] Field of Search ..... 83/401, 408, 718, 719, 83/730, 404, 713, 302, 425, 435.1, 437, 491, 477.2, 255, 605, 597, 607; 144/30, 3 R

[56] References Cited

U.S. PATENT DOCUMENTS

| | | | |
|---|---|---|---|
| 2,467,728 | 4/1949 | Burt | 83/435.1 X |
| 3,367,375 | 2/1968 | Watson | 144/30 X |
| 4,091,697 | 5/1978 | Cailey | 83/408 |
| 4,098,310 | 7/1978 | Sanford et al. | 144/30 X |
| 4,148,344 | 4/1979 | Critchell | 144/3 R |
| 4,149,577 | 4/1979 | Matusewicz et al. | 83/730 |
| 4,207,787 | 6/1980 | Lewallyn | 83/408 |

*Primary Examiner*—Donald R. Schran

[57] ABSTRACT

Disclosed is a machine for manufacturing wood stakes from boards, preferably from lengths of 2×4's or 2×6's. The machine is adjustable to provide stakes of virtually any length. The machine consists of two stations, the first station comprising a reciprocally movable carriage for holding a plurality of boards, a saw or other cutting means which cuts on a plane parallel to the direction of travel of the carriage, an endless conveyor to receive the slice of wood cut from at least one board thereon as the carriage passes the saw, another endless conveyor engagable with the carriage for moving the carriage in a reciprocating manner, and a second station comprising a second saw which is mounted to cut transversely to the direction of travel of the slice of board, and means to present the slice of wood to the second saw in order to bisect same.

11 Claims, 6 Drawing Figures

MACHINE FOR MAKING WOOD STAKES

BACKGROUND OF THE INVENTION

1. Field of the Invention

The invention relates to a machine for cutting wood stakes useful in the surveying art. More particularly, the invention is related to a machine for manufacturing stakes from wood 2×4's or 2×6's, of virtually any length, at a high rate of speed.

2. The Prior Art

As a practical matter, wood stakes useful for marking survey points, marking building sites and the like have been made by hand. That is, using a hand or mechanical saw each stake is cut one at a time. The cost and time involved in making a large number of stakes makes such methods very undesirable.

A review of the literature has revealed that no effort has been made to provide a mechanized method of producing wood stakes in quantity at a sufficiently high rate, such as at least 500 to 1000 stakes per hour.

In reviewing the art related to saw mills, generally, the following patents were discovered and are cited hereinbelow. U.S. Pat. No. 1,329,634 issued to Schumacher et al. for an apparatus for trimming plaster board. While this device provides for longitudinal and transverse cutting (of plaster board) the plasterboard stock is retained upon a single tray and positioned for trimming.

U.S. Pat. No. 2,931,401 to R. D. Lambert is directed to a trim saw apparatus for providing longitudinal and transverse cuts to trim a clamped sheet of plywood. The apparatus has a single work station with both longitudinal and transverse saw over with the work piece is moved.

U.S. Pat. No. 3,056,438 in A. C. McCall describes a side feed means for a saw mill carriage. This provides stock material to be cut in the proper arrangement for a longitudinal cut. A U.S. Pat. No. 3,399,630 to J. L. Wilson provides a reciprocal motivation and tracking means for a saw mill carriage. However, an endless track is not disclosed. In a similar manner, reference is made to U.S. Pat. No. 3,464,467 issued to T. F. Meis. More recent patents of interest are U.S. Pat. Nos. 3,818,790 and 3,985,055.

SUMMARY OF THE INVENTION

A machine for manufacturing wood stakes cut from prepointed boards comprising:

a first station, said first station including a first cutting means for cutting a longitudinal slice of said board.

carriage means for holding a plurality of said boards, being reciprocally movable and having means for sequentially presenting a predetermined width of at least one of said boards to the cutting means for cutting said longitudinal slice as said board is moved longitudinally with respect to said first cutting means, an endless conveyor having at least one linkage means engagable with said carriage means for moving said carriage means to a position whereby said presented board may be sliced longitudinally by said cutting means and thereafter said linkage means disengages from said carriage means, means for returning said carriage means to its original position, a second endless conveyor for receiving said longitudinal slice of board;

a second station, including a second cutting means, mounted transverse to said second endless conveyor means for bisecting said slice of board, ejection means for ejecting said slice of wood from said second endless conveyor means and for presenting said slice of board to said second cutting means.

It is an object of the present invention to provide a machine for cutting wood stakes.

It is a further object to provide a machine for cutting stakes from wood boards.

Another object is to provide a machine for cutting stakes from prepointed wood boards at a high rate of speed, preferably in the amount of at least 500 stakes per hour.

Another object is to provide a machine for automatically cutting wood stakes from prepointed 2×4's or 2×6's, of any suitable length, at a variable rate depending on length of the stake, preferably in the amount of at least 500 stakes per hour.

BRIEF DESCRIPTION OF THE DRAWINGS

The above and other objects, advantages and features of the invention will become more apparent upon consideration of the following specification, taken in connection with the accompanying drawings, wherein.

PREFERRED EMBODIMENTS OF THE INVENTION

Figure 1:
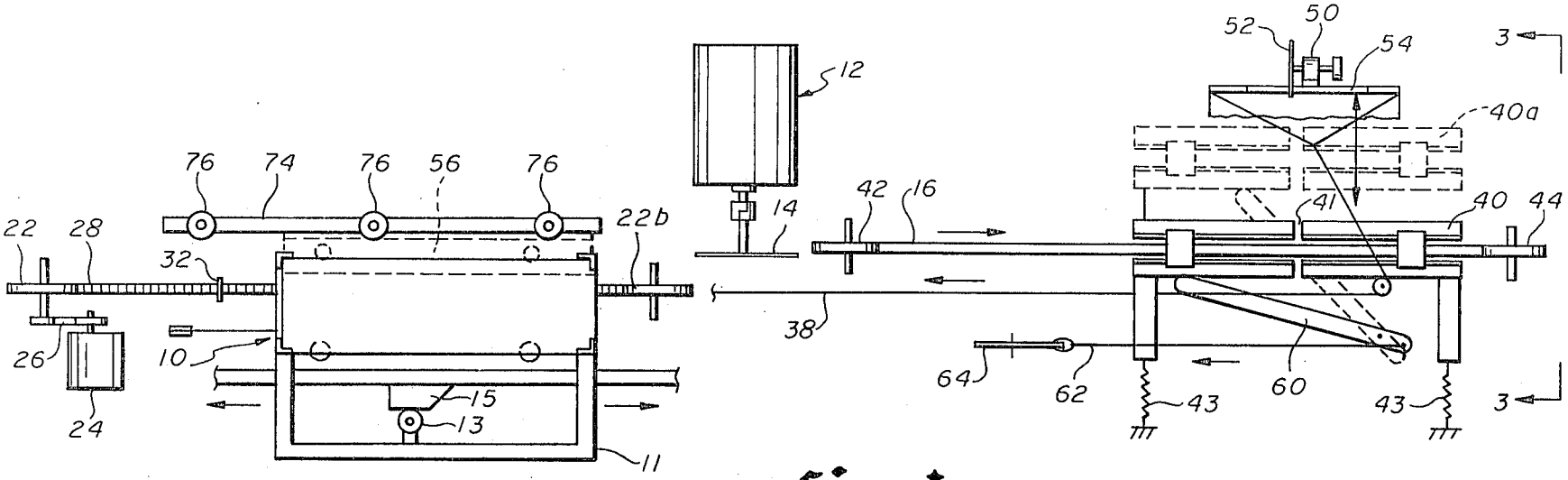
FIG. 1 is a cross-section plan schematic view of the stake cutting machine of the invention illustrating a first and second work station with the initial, longitudinal cut occuring at the first station, to the left of the drawing.

Referring to FIG. 1, the invention generally comprises two work stations. At the first station there is provided a reciprocally movable carriage 10 in which is loaded sections of boards 18 from which the stakes are to be cut. The carriage 10 is moved essentially past a cutting tool 12, shown in the drawings to be a saw having a blade 14 which is mounted to cut a longitudinal slice from at least one of the boards 18 stacked in the carriage 10.

The invention is particularly suited for cutting the stakes from lengths of 2×4 or 2×6 boards. However, there is no practical limitation to dimensions of the boards. It is primarily the user's choice and is dictated by personal preference. In addition, it has been found that if the boards are precut to have pointed ends, prior to their being loaded in carriage 10, the finished stakes may be bundled without further handling. The prepointing may be accomplished by mounting a saw in such a manner that stacks of boards may be cut in a single stroke of the saw. In this manner, the prepointed stack of boards may be loaded simultaneously in the carriage 10, for cutting the stakes therefrom.

The carriage 10 is moved past the saw blade 14 by operation of an endless conveyor 28, driven by a suitable motor 24 and, if necessary, drive mechanisms 26 connected to a drive sheeve 22. Mounted on the endless conveyor is at least one linkage 32 engagable with the carriage 10. The engagement is accomplished by the linkage 32 contacting a finger 30 or other means extending from the carriage 10. As the linkage 32 travels with the endless conveyor 28, it engages the finger 30 and moves the carriage with the conveyor 28 as it travels in a direction aligned longitudinally with the boards 28 stacked in the carriage 10.

Figure 2:
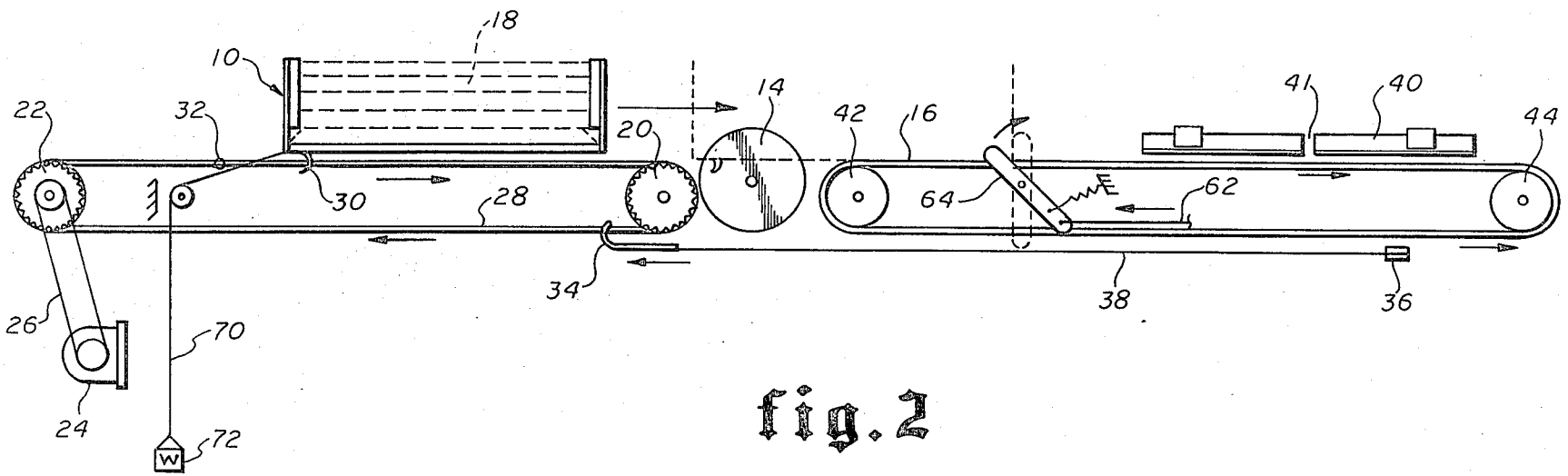
FIG. 2 is a cross-section elevational schematic view of the stake cutting machine shown in FIG. 1.

The return sheeve 20 of the endless conveyor 28 system marks the terminous of travel for the carriage 10. As the carriage 10 moves past the saw blade 14 to provide a complete longitudinal slice of board, the finger 30 disengages from the linkage 32. A resilient means 70, 72, shown in FIG. 2 to be a counterweight, is connected to the carriage 10 and causes the carriage 10 to be returned to its original, starting position. Thus, the carriage 10 is provided with reciprocal motion for taking successive slices from the boards mounted on the carriage 10.

Figure 4:
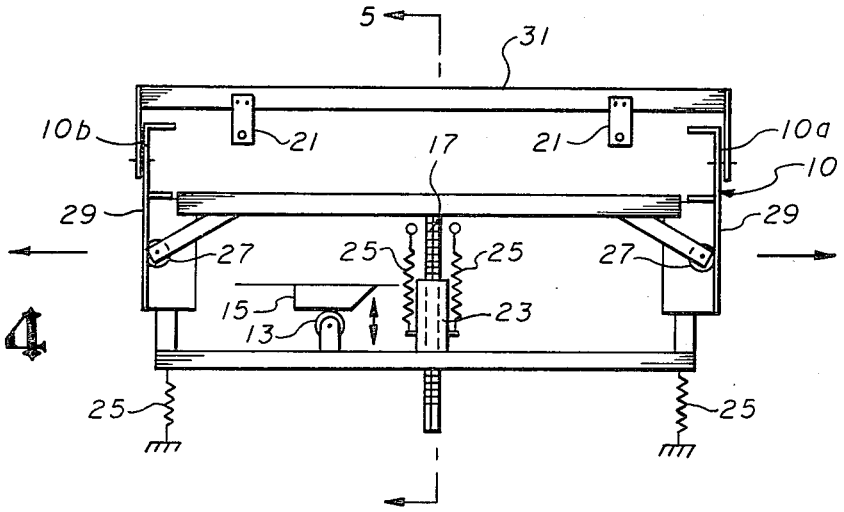
FIG. 4 is a plan schematic view of the carriage of the invention.

A fresh portion of board is presented for cutting a successive slice by action of a board advancing means 19, best illustrated in FIG. 4, mounted on the reverse side of the carriage 10. Basically, there is provided a cam 15, located on a superstructure 71 holding the carriage 10, saw 12 and endless conveyor 28 and the like; and, a cam follower 13 mounted on the leverage member 11 of the board advancing means 19. As the carriage 10 is returned to its original, at rest position, shown in FIG. 1, the cam follower 13 traverses the cam 15, causing the leverage member to be forced away from the superstructure 71. Mounted on the upper portion of the leverage member 11 is a pawl member 23 engaged with a rachet member 17 connected at one end to the board advancing means 19.

Figure 5:
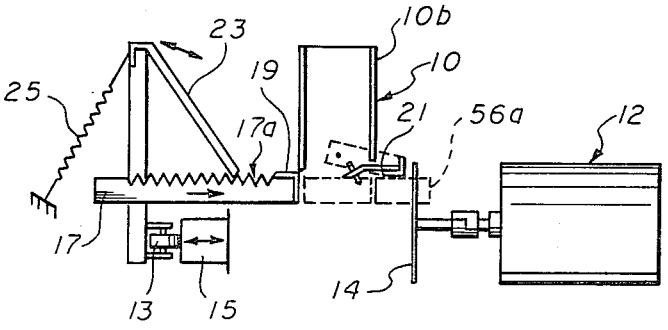
FIG. 5 is a schematic, elevational end view of the carriage in relation to the longitudinal cutting saw taken along the line 5—5 of FIG. 4.

The cam action forcing the lower portion of the leverage member 11 from the superstructure 71 causes the pawl to force the rachet 17 and board advancing means 19 to maintain pressure against the stacked boards 18. The pawl 23 is held firmly against the rachet 17 teeth by the force of at least one spring 25 connected at one end to the superstructure 71 and the other end to the board advancing means 19. The boards 18 are stopped in their forward movement by mounted bearing surfaces 76. The board is prevented from moving, in its position for cutting by retaining means 21 mounted on the carriage 10. The retaining means 21 are shown to be pointed spikes or other suitable means engagable with a portion of the forward most board **56*a* to prevent its backward movement in the carriage as the board 56*a* is passed through the blade 14 (as shown in FIG. 5). When board advancing means 19 has advanced to a point essentially beneath holder 10*a*, the pawl 23 is tripped, allowing rachet member 17 to be returned to its backward most point. A new board drops into the cutting plane with board advancing means 19** contacting same.

The leverage member 11 is returned to its essentially vertical position by suitable biasing means 25, as shown in FIG. 5.

The board advancing means 19 preferably is provided with suitable guide rails 29 and wheels or bearings 27 to provide a uniform pressure over the full length of the boards 18 carried in the carriage 10. Also, it is preferred to have a suitable holder or other means **10*a* and 10*b* mounted on the carriage 10 for holding a plurality of boards 18**.

Figure 6:
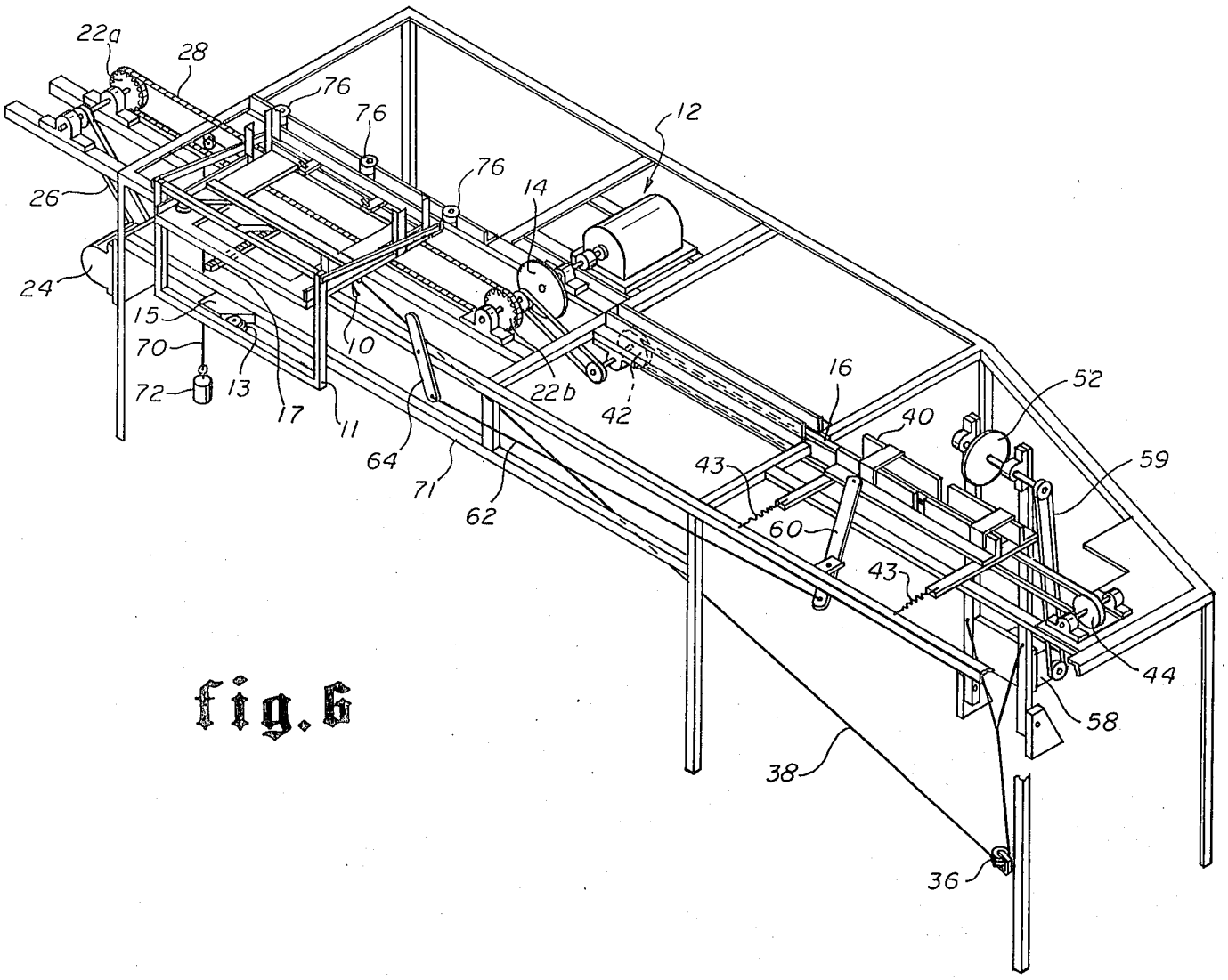
FIG. 6 is a perspective, schematic view of the machine of the invention.

The slice of wood cut from the board **56*a* is fed to a second endless conveyor 16 which traverses sheeves 42 and 44, shown to the right of FIG. 1. (and shown in perspective view in FIG. 6). The second endless conveyor 16** carries the slice of wood to the second station.

The second station comprises a second cutting means 52, shown to be a saw blade 52 and power source 50 mounted on a suitable frame 54. The saw blade 52 is mounted transversely to the direction of travel of the second endless conveyor 16.

The wood slice is received in an ejector means 40 having a cutting guide 41 for guiding the second cutting means 52 to bisect the wood slice (not shown). The wood slice is moved toward the second cutting means 52 by movement towards same while held in the ejector means 40. The second cutting means 52 is moved simultaneously, in its transverse direction by force applied thereto by a lanyard 62 connected at one end to the frame 54, carrying the second cutting means 52, and at the other end to means 34 for engaging the linkage 32 in the first endless conveyor 28.

Thus, as the first endless conveyor 28 moves the linkage past the lanyard engaging means 34 (FIG. 2), the lanyard is pulled in the direction of travel of the conveyor 28, away from the second station. The frame 54 and saw blade 52 are pulled toward the ejector means 40, which itself has moved to the position represented by numeral **40*a***.

The bisected slice of wood then may be fed to a collection site (not shown), allowed to fall into a suitable receptacle or otherwise collected for ultimate disposal.

Figure 3:
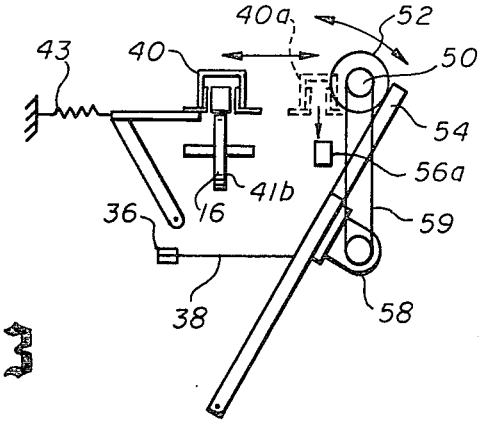
FIG. 3 is a schematic end view, taken along the line 3—3 of FIG. 1, of the second station of the stake cutting machine of the invention showing the transverse saw.

The ejector means 40 is moved to its **40*a* position by action of a suitable mechanism 60, such as illustrated in FIGS. 1 and 3. However, this may be automated or manual. The embodiment illustrated is shown to be manually operated in order to provide operator discretion in presenting the wood slice for bisection. The operator would cause the ejector means 40 to move forward by pulling a lever 64, connected to a "kick-out" mechanism 60 by suitable connecting means 62, shown in FIG. 1** to be a cable.

Upon release of the lever 64, the ejector 40 is returned to its normal position by suitable biasing means 43, such as a spring or hydraulic means. The operation of the second station is best illustrated in FIG. 3, wherein the transverse bisecting cut is taken with a cutting means 52 mounted on a frame 54 or other suitable means. As illustrated, a power source 58 provides power to the cutting means 52 by use of suitable drive mechanisms 50 and 59 connecting the two. As the frame 54 is moved automatically toward the ejector 40, an operator may cause the ejector 40 to be moved toward the cutting means 52.

It can be readily seen that there are various options available in modifying the invention to provide various lengths and widths of wood stakes, without departing from the scope of the invention. However, it is intended that all matter contained in the above description and shown in the accompanying drawings are to be interpreted as illustrative and not in any way limiting the scope of the invention.

I claim:

1. A machine for manufacturing wood stakes cut from prepointed boards comprising:

a first station, said first station including a first cutting means for cutting a longitudinal slice of said board, carriage means for holding a plurality of said boards, being reciprocally movable and having means for sequentially presenting a predetermined width of at least one of said boards to the cutting means for cutting said longitudinal slice as said board is moved longitudinally with respect to said first cutting means, an endless conveyor having at least one linkage means engagable with said carriage means for moving said carriage means to a position whereby said presented board may be sliced longitudinally by said cutting means and thereafter said linkage means disengages from said carriage means, means for returning said carriage means to its original position, a second endless conveyor for receiving said longitudinal slice of board;

a second station, including a second cutting means, mounted transverse to said second endless conveyor means for bisecting said slice of board, ejection means for ejecting said slice of wood from said second endless conveyor means and for presenting said slice of board to said second cutting means.

2. The machine of claim 1, wherein said sequential presenting means, associated with said carriage, includes a board advancing means, mounted on said carriage, contacting at least one of said boards held in said carriage means, biasing means connected to said board advancing means for maintaining pressure against said board, rachet means, on said board advancing means, for advancing said board advancing means in order to sequentially present a predetermined width of at least one of said boards to the cutting means.

3. The machine of claim 1, including cam means, and a cam follower on said board advancing means, whereby said cam follower traverses said cam when said carriage means is moved to its original position, causing said rachet means to be moved in a direction toward said board to maintain pressure on said board.

4. The machine of claim 1, wherein said second endless conveyor is positioned to receive said longitudinal slice of board and extends to a position at said second station to carry said slice of board to said ejector means.

5. The machine of claim 1, including holder means for receiving said ejected slice of board at said second station.

6. The machine of claim 5, wherein said holder means includes a cutting guide for said second cutting means in order that said second cutting means may bisect said slice of board, thereby producing two prepointed wood stakes.

7. A machine for manufacturing wood stakes from prepointed boards comprising, a first station, including a first cutting means for cutting a longitudinal slice, of a predetermined width, from at least one board presented to said first cutting means, carriage means for holding a plurality of prepointed boards being reciprocally movable in a direction parallel to said first cutting means and having means for sequentially presenting a predetermined width of at least one of said boards to the first cutting means, an endless conveyor having a linkage thereon engagable with said carriage means for moving said carriage means from an original, at rest position, to a second position whereby said first cutting means cuts said longitudinal slice from said at least one board carried thereon, resilient means for returning said carriage to its original position, a second endless conveyor means for receiving said longitudinal slice of board, a second position, including a second cutting means, mounted transverse to said second endless conveyor means for bisecting said slice of board, ejection means for receiving said slice of board carried on said second means, movable transversely to said second conveyor means and for presenting said slice of board to said second cutting means for bisecting said slice of board to provide two prepointed wood stakes.

8. The machine of claim 7, including lanyard means, connected at one end to said second cutting means, the other end having means for engaging said linkage of said first endless conveyor, said engagement being made as said linkage is released from said carriage means.

9. The machine of claim 8, wherein said second cutting means is moved toward said ejection means by said lanyard as said lanyard is engaged with and carried by said linkage on said first endless conveyor, the second cutting means bisecting said slice of board held in said ejection means.

10. The machine of claim 7, wherein said sequential presenting means, associated with said carriage, includes a board advancing means, mounted on said carriage, contacting at least one of said boards held in said carriage means, biasing means connected to said board advancing means for maintaining pressure against said board, rachet means, on said board advancing means, for advancing said board advancing means in order to sequentially present a predetermined width of at least one of said boards to the cutting means.

11. The machine of claim 7, including cam means, and a cam follower on said board advancing means whereby said cam follower traverses said cam when said carriage means is moved to its original position, causing said rachet means to be moved in a direction toward said board to main pressure on said board.

* * * * *